US005123370A

United States Patent [19]

Woidich et al.

[11] Patent Number: 5,123,370

[45] Date of Patent: Jun. 23, 1992

[54] BLOWOUT SYSTEM FOR EJECTION AND DISCHARGE TUBES OF SUBMARINES

[75] Inventors: Richard Woidich, Altenholz; Josef Schmitt, Dänischhagen; Peter Hartz, Kiel, all of Fed. Rep. of Germany

[73] Assignee: Howaldtswerke-Deutsche Werfe AG, Kiel, Fed. Rep. of Germany

[21] Appl. No.: 298,144

[22] Filed: Jan. 18, 1989

Related U.S. Application Data

[63] Continuation of Ser. No. 185,743, Apr. 25, 1988, abandoned, which is a continuation of Ser. No. 23,362, Mar. 9, 1987, abandoned, which is a continuation of Ser. No. 889,556, Jul. 25, 1986, abandoned, which is a continuation of Ser. No. 801,997, Nov. 25, 1985, abandoned, which is a continuation of Ser. No. 634,680, Jul. 31, 1984, abandoned, which is a continuation of Ser. No. 380,800, May 21, 1982, abandoned.

[30] Foreign Application Priority Data

Jun. 6, 1981 [DE] Fed. Rep. of Germany ..... 3122631

[51] Int. Cl.[5] ..... B63G 8/28

[52] U.S. Cl. ..... 114/319; 124/73; 124/75

[58] Field of Search ..... 251/54, 55; 137/614.19, 137/508, 613, 614.2, 461, 462; 124/73, 75, 79; 114/20 R, 238, 316-320; 89/1.810, 1.181, 1.809; 91/426

[56] References Cited

U.S. PATENT DOCUMENTS

| | | | |
|---|---|---|---|
| 430,101 | 6/1890 | Zalinski | 124/75 |
| 2,043,203 | 6/1936 | Sorensen | 251/55 |
| 2,514,747 | 7/1950 | Daniels | 91/426 |
| 3,087,386 | 4/1963 | Ring et al. | 89/1.810 |
| 3,108,562 | 10/1963 | Riedel | 124/75 |
| 3,971,405 | 7/1976 | Millar et al. | 137/461 |

*Primary Examiner*—Edwin L. Swinehart
*Attorney, Agent, or Firm*—John C. Smith, Jr.

[57] ABSTRACT

A blowout system for ejection and discharge tubes of submarines is provided which permits an ejection of weapons from a torpedo tube, said weapons not having an own propulsion, and which prevents the intrusion of water after the blowout operation is terminated. The system is subsequently installable as a compact unit and has an outlet opening which is closed by a check valve. The outlet opening is continued by a buffer tube, a blowout valve arranged between a compressed-gas container and said buffer tube being provided for supplying said compressed gas.

14 Claims, 4 Drawing Sheets

BLOWOUT SYSTEM FOR EJECTION AND DISCHARGE TUBES OF SUBMARINES

This is a continuation of copending application Ser. No. 185,743 filed Apr. 25, 1988 now abandoned which in turn is a continuation of application Ser. No. 023,362 filed Mar. 9, 1987 (now abandoned) which in turn is a continuation of application Ser. No. 889,556 filed Jul. 25, 1986 (now abandoned) which in turn is a continuation of application Ser. No. 801,997 filed Nov. 25, 1985 (now abandoned) which in turn is a continuation of application Ser. No. 634,680 filed Jul. 31, 1984 (now abandoned) which in turn is a continuation of application Ser. No. 380,800 filed May 21, 1982 (now abandoned).

FIELD OF THE INVENTION

This invention relates to a blowout system for ejection and discharge tubes of submarines for ejecting weapons by means of compressed gas which is suppliable from associated compressedgas containers and is controllable via a control circuit and instrument part.

In arrangements of this type, there is the problem of ejecting rocket bodies or other weapons from a torpedo tube which do not have their own propulsion or do not have sufficient propulsion to leave the torpedo tube with high speed.

DESCRIPTION OF THE PRIOR ART

The conventional blowout systems consist of voluminous pressure bottles arranged outside of the torpedo tube and provided with connecting lines. Furthermore, it is known to press water into the torpedo tube in large quantities and at high pressure. These arrangements are too complex for many uses and above all things have the deficiency that re-equipment is difficult to perform in existing systems.

SUMMARY OF THE INVENTION

It is, therefore, an object of the present invention to avoid the above-mentioned disadvantages and to provide a blowout system for ejection and discharge tubes of submarines which insures a subsequent installation in existing systems and permits in a simple manner lowering the initial pressure impact and preventing an instrusion of water into the blowout system after terminated blowout operation.

To attain this object the present invention provides a blowout system for ejectiong and discharge tubes of submarines for ejecting weapons by means of compressed gas, comprising a compressed-gas container arranged in the base region of an ejection and discharge tube and having at the side facing the weapon an outlet opening provided with a check valve; a buffer tube connected at one end to the outlet opening and passing through the compressed-gas container, said buffer tube having at its terminal region remote from the check valve passage openings leading to the interior of the compressed-gas container, a blowout opening and a blowout valve for controlling the blowout opening, and a control circuit and instrument part also arranged in the base region of the ejection and discharge tube and operatively connected to the compressed-gas container. Thereby, intrusion of water is avoided in a simple manner and the initial pressure impact is lowered via the buffer tube. It is also possible to use the buffer tube in the compressed-gas container for increasing the strength of the compressed-gas container.

A proper operation is achieved to advantage when the shutting force of the check valve corresponds to a pressure differential of at least 0.5 bar.

An advantageous arrangement is one in which the compressedgas container defines a unit with the control circuit and instrument part.

In order to vary the opening process of the blowout valve in dependence of the submersion depth, it is proposed that the opening stroke of the blowout valve be adjustable. via a linkage. As an alternative, it is proposed that the blowout valve be coupled with a bilaterally pressurizable control piston arrangement, the cylinder spaces defined being interconnected via a restriction arrangement with an adjustable cross section.

In order to insure a control independent of the electrical system when the firing operation has once been initiated, it is proposed that a firing valve be provided which is connected by a control line to the buffer tube for maintaining the firing position. Thereby, a quasiarresting is achieved in the firing position.

For avoiding a high initial pressure impact in the torpedo tube, it is proposed that the blowout valve extend with a shutoff cone into the blowout opening in such a way that in the first part of the opening motion a minimum portion of the-opening cross section of the blowout opening is released.

BRIEF DESCRIPTION OF THE DRAWINGS

Two embodiments of the invention will now be described by way of example and with reference to the accompanying drawings in which.

DESCRIPTION OF THE PREFERRED EMBODIMENTS

Figure 1:
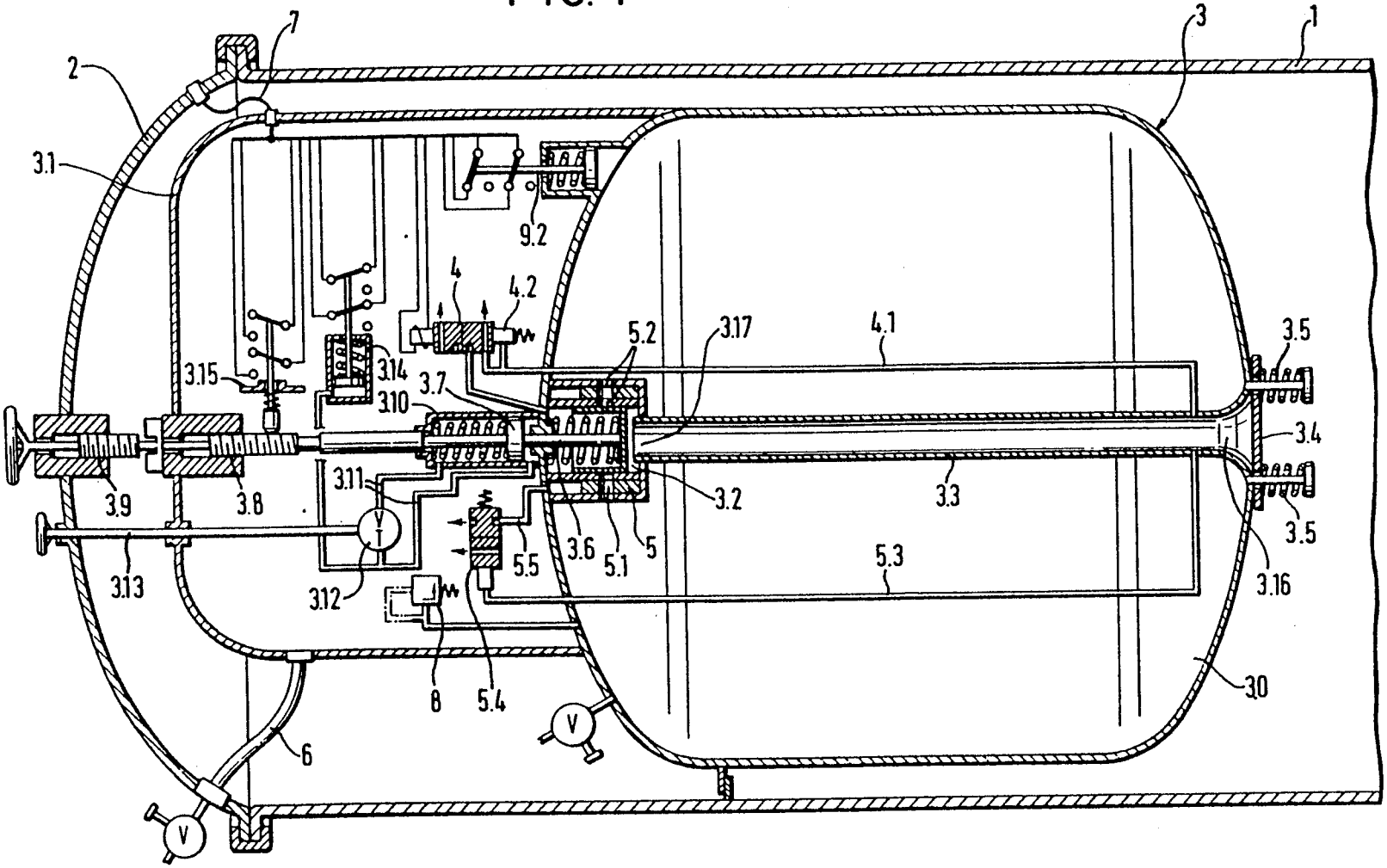
FIG. 1 shows a blowout system of the invention in a torpedo tube.

FIG. 1 shows a torpedo tube 1 which is provided with a base cap 2 and accommodates a blowout system 3. The blowout system 3 is defined by a compressed-gas container 3.0 and a control circuit and instrument part 3.1 which are installed as a unit in the torpedo tube 1.

The compressed-gas container 3.0 is provided at the side facing the weapon with an outlet opening 3.16 and is controlled by a check valve 3.4 having compressing springs 3.5. The outlet opening 3.16 is connected to a buffer tube 3.3 which is passed through the-compressed-gas container 3.0. At the terminal region, there are arranged passage openings 5.2 to the interior of the compressed-gas container 3.0. The actual blowout opening 3.17 to the buffer tube 3.3 is controlled by a blowout valve 3.2. The opening stroke of the blowout valve 3.2 is adjustable by means of a linkage 3.8.

The check valve 3.4 is biased via the compression springs 3.5 in shutting direction such that a pressure differential of at least 0.5 bar results.

For controlling the opening speed of the blowout valve 3.2 depending on the submersion depth, the two sides of the piston of a bilaterally pressurizable control piston arrangement 3.7 are interconnected via lines 3.11 to a cylinder 3.10, the flow cross section and thus the opening speed being variable depending on the submersion depth by means of an adjustable restriction means 3.12. Said adjustable restriction means 3.12 is adjustable via an operating spindle 3.13 through the shut base cap 2 from the interior of the boat. In order to maintain a minimum pressure at the low pressure side of the bilaterally pressurizable control piston arrangement 3.7, a low pressure accumulator 3.14 is associated with this side. Of course, the adjustment may also be performed automatically by the water pressure dependent on the submersion depth.

The actual blowout operation for ejecting weapons is initiated by a firing valve 5 which is controlled electrically in this case. This firing valve 4 normally blocks the space behind the blowout valve 3.2 and vents the buffer tube 3.3 via a connecting line 4.1. When the valve 4 receives an electric firing pulse the valve closes the connecting line 4.1 and vents the space behind the blowout valve 3.2 resulting in a decrease in pressure in said space so that the higher pressure on the front side of the valve opens the valve. The opening of the valve 3.2 causes the piston rod 3.6 to move the piston 3.7 in the cylinder 3.10.

Figure 3:
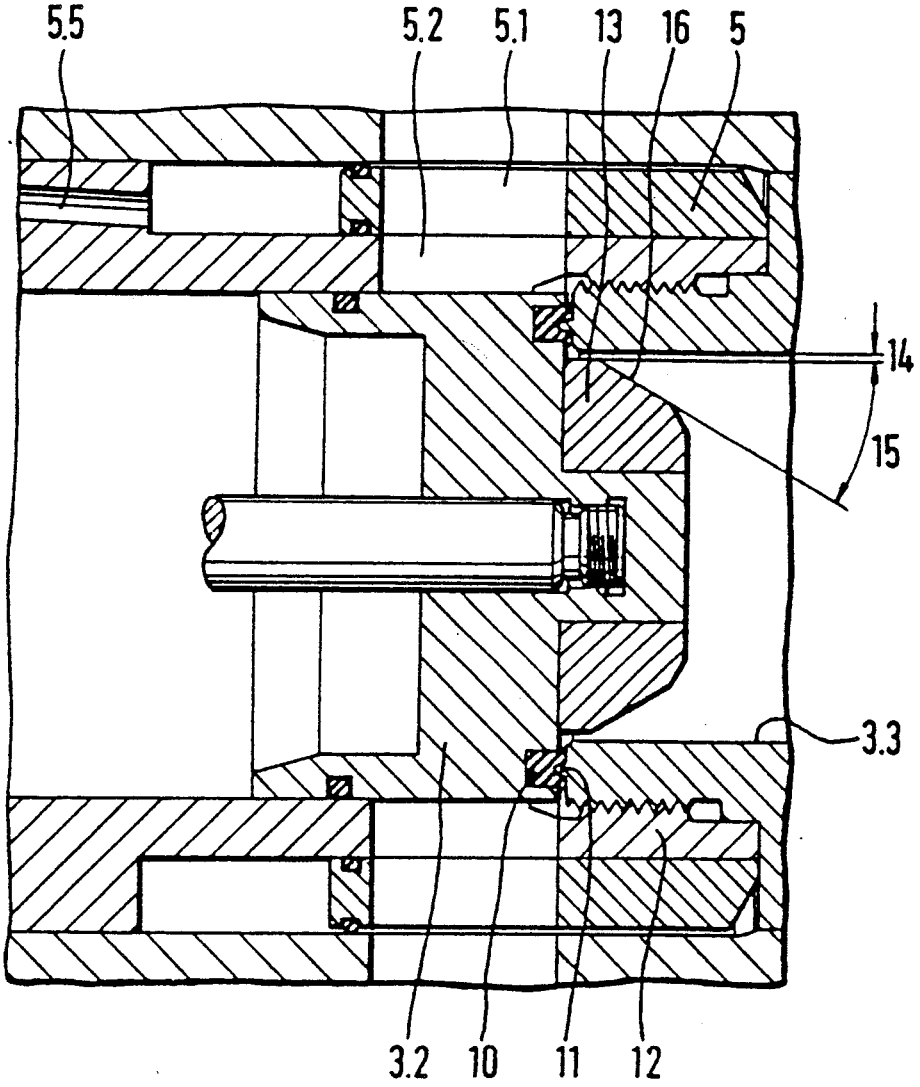
FIG. 3 is a cross section showing details of a blowout valve.

The blowout valve 3.2 is surrounded for instance by an annular shut-off slide 5, and it is normally held in the open position shown in FIG. 3 by springs (not shown) such that its radial bores 5.1 register with the associated passage openings 5.2 of the valve casing. In this position the slide is surrounded at all sides by the high pneumatic pressure of the storage container 3. This pressure is also present in the venting line 5.5 and is prevented from escaping by the valve 5.4 When an impermissibly high pressure exists in the torpedo tube 1 or in the buffer tube 3.3, the switch valve 5.4 is operated via a line 5.3 which pressure-relieves the shut-off slide 5 unilaterally via the venting line 5.5 so that the shut-off slide 5 is moved towards the line 5.5 into a locking position in which the passage through the passage openings 5.2 to the blowout valve 3.2 is blocked. The switch valve 5.4 is arrested in the venting position and the shut-off slide 5 remains in the locking position, respectively, as long as the pressure in the buffer tube 3.3 is too high. It is of course also possible to arrest the shut-off slide 5 in the shutting position.

In the interest of an easy manipulatability and above all things for cases of a re-equipment for already existing torpedo tubes 1 it is important that the control circuit and instrument part 3.1 defines a structural and functional unit with the compressed-gas container 3.0, the connecting lines to the interior of the boat, namely, a venting line 6 and an electrical supply line 7 as well as adjustment means 3.9 and the operating spindle 3.13, being provided readily detachable in the base cap 2 of the torpedo tube 1.

Figure 2:
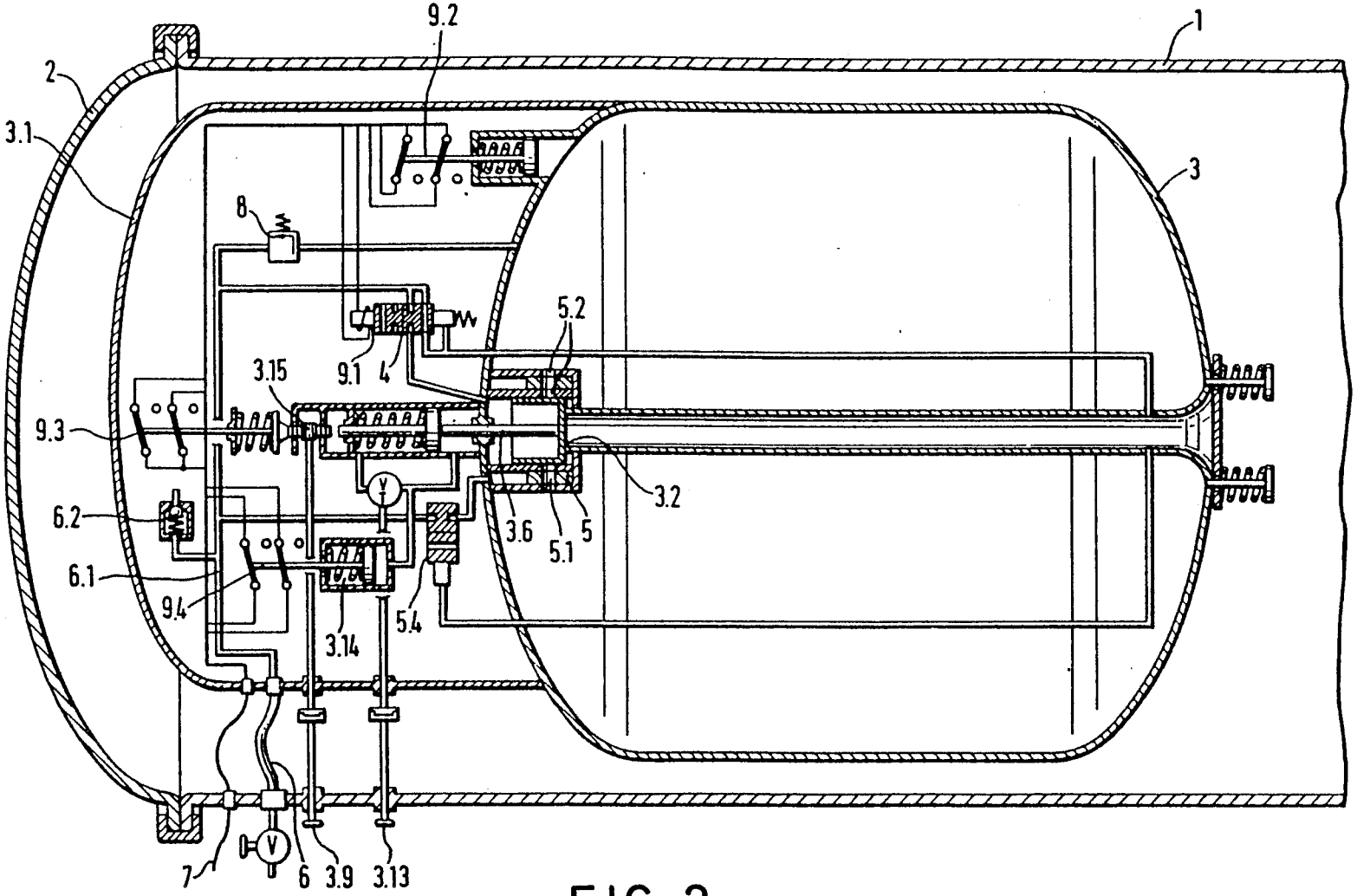
FIG. 2 shows a further embodiment of a blowout system.

The blowout system will be particularly easy and failureproof to handle, however, when the operating and supplying components are not passed through the base cap 2, but through the wall of the torpedo tube 1 as illustrated in FIG. 2. The stroke restriction of the blowout valve 3.2 via a piston rod 3.6 dependent on submersion depth is represented by a cam 3.15 which is variable in its position by means of the adjustment means 3.9 in the form of an operating spindle.

The venting and blowout bores arranged at the encapsulated control circuit and instrument part 3.1, at the firing valve 4, the switch valve 5.4 for the shutoff slide 5 as well as from a switch valve 8 of the compressed-gas container 3.0 are combined into a common venting line 6.1 which leads in the venting line 6 to the interior of the boat. It is thereby prevented that inevitable moisture which may escape from the said valves collects in the control circuit and instrument part 3.1 and there results in functional defects at the electric components. This involves an electrical control 9.1 of the firing valve 4, an electrical monitoring system 9.2 of the pressure in the compressedgas container 3.0, an electrical monitoring system 9.3 of the stroke restriction or interlocking represented by the cam 3.15 as well as an electrical monitoring system 9.4 of the position of the pressure-liquid accumulator 3.14.

By means of the venting line 6.1, the relief of possibly resulting overpressure in the encapsulated control circuit and instrument part 3.1 is also effected. To this end, an additional line is connected via a check valve 6.2, the check valve 6.2 being installed in such a way that only the flow direction from the control circuit and instrument part 3.1 to the line 6.1 is released.

In the detail illustration of the blowout valve 3.2 according to FIG. 3, it is shown that in the shut condition a valve cone 13 rests via a sealing element 10 on a seat surface 11 of the valve casing 12. The compressed gas from the compressedgas container 3.0 communicates through supply openings 5.2 with the annular surface 17 of the blowout valve 3.2 surrounding the sealing element 10. When the blowout valve 3.2 is opened due to the pressure exerted by the compressed gas on the annular surface 17, compressed gas flows from the compressed-gas container 3.0 via the supply openings 5.2 through the opening gap into the buffer tube 3.3. In order to confine the effects of this pressure impact, the blowout valve 3.2 is provided with a spigot-shaped attachment which through about 10 per cent of the opening path defines a constant annular gap to the buffer tube 3.3, the size 14 of which is no more than 3 per cent of the maximum opening cross section of the blowout valve 3.2. Only after the blowout valve has exceeded about 10 per cent of its total opening path, the annular gap enlarges and releases a larger opening cross section according to the cone angle 15 of a cone 16 adjacent to the attachment.

Figure 4:
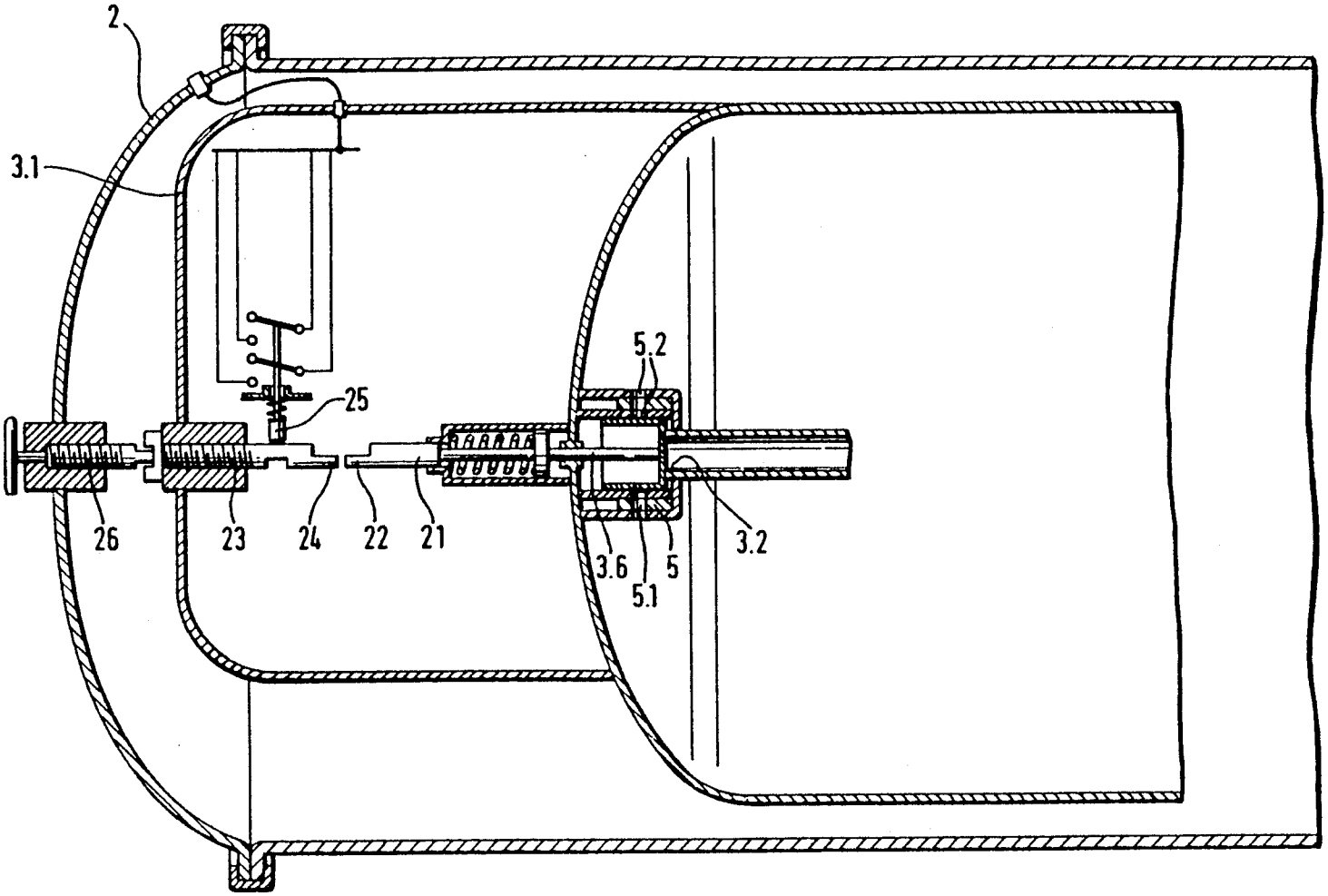
FIG. 4 shows an interlocking arrangement of a blowout system.

FIG. 4 shows an interlocking system for the blowout valve 3.2 which prevents an unintended operation of the filled blowout system during transportation or also in the torpedo tube 1.

To this end, the piston rod 3.6 has a cylindrical extension 21 the end 22 of which is reduced half in a length corresponding to the valve stroke. A spindle 23 having reduced end 24 is mounted rotatable, but axially non-shiftable in the control circuit and instrument part 3.1. The cylindrical extension 21 and the spindle 23 are in alignment so that the reduced ends 22 and 24 oppose each other in the locking position with a minimum spacing, but after a rotation of the spindle 23 by 180° permit an unobstructed opening of the blowout valve 3.2 in the releasing position.

By means of a switch contact 25, the locking position is electrically monitored. The interlocking may be operated through the base cap 2 by means of an extension spindle 26 even when the torpedo tube 1 is flooded.

The invention may be embodied in other specific forms without departing from the spirit or essential characteristics thereof. The embodiments are therefore to be considered in all respects as illustrative and not restrictive.

What is claimed is:

1. A blowout system for ejection and discharge tubes of submarines for ejecting weapons by means of compressed gas, comprising (a) a compressed-gas container arranged in the base region of an ejection and discharge tube and having at the side facing the weapon an outlet opening;

(b) a buffer tube connected at one end to the outlet opening and passing through the compressed-gas container, said buffer tube having, at its terminal region remote from the outlet opening, passage openings leading to the interior of the compressed-gas container, a blowout opening and a blowout valve for controlling the blowout opening;

(c) a check valve arranged to open and close said outlet opening and means biasing said check valve towards its closed position and adapted to maintain a pressure differential of at least 0.5 bar between the interior of said buffer tube on one side of said check valve and the interior of said ejection and discharge tube on the opposite side of said check valve to lower the initial pressure impact; and (d) a control circuit and instrument part also arranged in the base region of the ejection and discharge tube and operatively connected to the compressed-gas container for controlling said blowout valve.

2. A system as set forth in claim 1, wherein the compressed-gas container defines a unit with the control circuit and instrument part.

3. A system as set forth in claim 1, wherein the opening stroke of the blowout valve is adjustable via a linkage.

4. A system as set forth in claim 1, wherein the blowout valve is coupled to a bilaterally pressurizable control piston arrangement and the cylinder spaces defined are interconnected via a restriction means with a variable cross section.

5. A system as set forth in claim 1, wherein a firing valve is provided which is connected by a control line to the buffer tube for maintaining the firing position.

6. A system as set forth in claim 1, wherein the blowout valve extends with a shutting cone (13) into the blowout opening such that in the first portion of the opening path a minimum portion of the opening cross section of the blowout opening is released.

7. A system as set forth in claim 1, wherein the blowout valve has associated therewith a switch valve for a controllable shut-off slide, said switch valve being connected via a control line to the buffer tube for an adjustment upon exceeding a pressure limit.

8. A system as set forth in claim 1, wherein a venting line and operating linkages are passed through the ejection and discharge tube into the interior of the boat.

9. A blowout system for ejection and discharge tubes of submarines for ejecting weapons by means of compressed gas, comprising:

(a) a compressed-gas container arranged in the base region of an ejection and discharge tube and having at the side facing the weapon an outlet opening;

(b) a buffer tube connected at one end to said outlet opening and passing through said compressed gas container, said buffer tube having at its terminal region remote from said outlet opening a blowout opening, at least one passage leading to the interior of said compressed-gas container and a blowout valve for controlling the flow of gas from said compressed-gas container through said buffer tube;

(c) a check valve arranged to open and close said outlet opening and means biasing said check valve towards said closed position and adapted to maintain a pressure differential of at least bar between the interior of said buffer tube on one side of said check valve and the interior of said ejection and discharge tube on the opposite side of said check valve to lower the initial pressure impact; and (d) control means for controlling the opening and closing of said blowout valve.

10. A system as set forth in claim 9 further comprising means for adjusting the opening stroke of said blowout valve.

11. A system as set forth in claim 9 further comprising a cylinder, a bilaterally pressurizable control piston in said cylinder, means connecting said piston to said blowout valve, conduit means connecting opposit ends of said cylinder, and valve means in said conduit means to control the rate of flow of fluid through said conduit means during movement of said piston.

12. A system as set forth in claim 9 further comprising a firing valve and conduit means connecting said firing valve to said buffer tube for maintaining the firing position.

13. A system as set forth in claim 9 wherein said blowout valve includes a shutting cone extending into said blowout opening in said buffer tube whereby said blowout opening is opened only a minimal amount upon initial opening of said blowout valve.

14. A system as set forth in claim 9 further comprising a shut-off valve for opening and closing said at least one passage leading to the interior of said compressed gas container, a switch valve, and further conduit means connecting said switch valve with said buffer tube, said switch valve being adapted to operate said shut-off valve to close said at least one passage when the pressure in said buffer tube exceeds a predetermined amount.

* * * * *